US011198028B2

(12) United States Patent
Andon

(10) Patent No.: US 11,198,028 B2
(45) Date of Patent: Dec. 14, 2021

(54) TRAMPOLINES AND CONNECTORS FOR TRAMPOLINES

(71) Applicant: VULY IP HOLDINGS NO 2 PTY LTD, Queensland (AU)

(72) Inventor: Joe Andon, Queensland (AU)

( * ) Notice: Subject to any disclaimer, the term of this patent is extended or adjusted under 35 U.S.C. 154(b) by 301 days.

(21) Appl. No.: 16/475,242

(22) PCT Filed: Nov. 29, 2017

(86) PCT No.: PCT/AU2017/051318
§ 371 (c)(1),
(2) Date: Jul. 1, 2019

(87) PCT Pub. No.: WO2018/098529
PCT Pub. Date: Jun. 7, 2018

(65) Prior Publication Data

US 2019/0351274 A1 Nov. 21, 2019

(30) Foreign Application Priority Data

Nov. 29, 2016 (AU) ..... 2016904899
Dec. 16, 2016 (AU) ..... 2016905218
Jul. 31, 2017 (AU) ..... 2017903015

(51) Int. Cl.

| | |
|---|---|
| ***A63B 5/11*** | (2006.01) |
| ***A63B 21/04*** | (2006.01) |
| ***A63B 6/00*** | (2006.01) |
| ***A63B 71/00*** | (2006.01) |
| ***A63B 21/02*** | (2006.01) |
| *A63B 21/055* | (2006.01) |

(52) U.S. Cl.
CPC ..... *A63B 5/11* (2013.01); *A63B 6/00* (2013.01); *A63B 21/023* (2013.01); *A63B 21/026* (2013.01); *A63B 21/04* (2013.01); *A63B 71/0054* (2013.01); *A63B 21/0552* (2013.01); *A63B 2071/009* (2013.01)

(58) Field of Classification Search
CPC .... A63B 5/11; A63B 5/00; A63B 5/02; A63B 5/08; A63B 5/12; A63B 6/00; A63B 21/026; A63B 21/023; A63B 21/04; A63B 21/0552; A63B 71/0054; A63B 71/022; A63B 2071/009; A63B 2005/085
See application file for complete search history.

(56) References Cited

U.S. PATENT DOCUMENTS 1,329,145 A * 1/1920 Seelig ..... A47C 23/30 5/247
7,314,125 B2 * 1/2008 Smaldone ..... F16F 7/00 188/372
8,911,331 B2 * 12/2014 DeBlanco ..... A63B 5/11 482/27

(Continued)

*Primary Examiner* — Megan Anderson
(74) *Attorney, Agent, or Firm* — Shaver & Swanson, LLP; Scott D. Swanson

(57) ABSTRACT

Provided herein is a hoop spring assembly for use in a mat connection system of a trampoline, in which the hoop spring assembly includes a pair of hoop portions hingedly connected by a pair of laterally positioned hinge members and a resilient member, such as an elastic band or coil spring, operably connected to each of the hinge members and extending therebetween. Mat connection systems and trampolines including such a hoop spring assembly are also provided.

20 Claims, 10 Drawing Sheets

(56) References Cited

U.S. PATENT DOCUMENTS

| | | | | |
|---|---|---|---|---|
| 9,399,153 | B2 * | 7/2016 | Green | A63B 25/10 |
| 10,124,198 | B2 * | 11/2018 | Haggerty | A63B 71/0054 |
| 2008/0090704 | A1 * | 4/2008 | Denis | A63B 5/11 482/28 |
| 2021/0138287 | A1 * | 5/2021 | Huting | A63C 19/04 |

* cited by examiner

TRAMPOLINES AND CONNECTORS FOR TRAMPOLINES

CROSS REFERENCE TO RELATED APPLICATIONS

This application claims priority to copending Patent Cooperation Treaty Application, No. PCT/AU2017/051318, filed on Nov. 29, 2017, which claims priority to Australian Patent Application No. 2017903015, filed on Jul. 31, 2017, which claims priority to Australian Patent Application No. 2016905218, filed on Dec. 16, 2016, which claims priority to Australian Patent Application No. 2016904899, filed on Nov. 29, 2016, the applications of which are hereby incorporated by reference for all purposes.

FIELD

This invention relates to a mat connection assembly for connecting adjacent mats of a trampoline. More specifically, it relates to a mat connection assembly for connecting adjacent mats of a trampoline park.

BACKGROUND

Trampoline parks typically include sections where multiple trampolines are arranged side by side with the jumping mats horizontal. In some parks, some trampolines can have part of the jumping mat extending horizontally and contiguous with a part which is inclined to the horizontal and perhaps even close to vertical. In some parks, some of the trampolines with horizontal mats are adjacent trampoline with mats inclined to the horizontal.

Trampolines which are currently used in trampoline parks typically include a steel frame with a rectangular flexible jumping mat secured to the frame by a large number of spaced apart extension springs, the axes of which are coplanar with the mat, and are arranged to extend and contract as a person jumps on the mat in order to give "bounce".

In such trampolines the extension springs and the space between the jumping mat and the frame across which the extension springs extend is typically covered by a padded safety barrier (or "padding") extending about the mat. That space is typically in the order of 300 mm wide but can be wider or narrower depending on the size of the trampoline. Thus, where two trampolines are arranged together with adjacent frames abutting, the spaces together can be in the order of 400 mm to 800 mm wide. Typically, a full width piece of safety padding is used to cover the adjacent springs of both trampolines and consequently such padding can be up to a metre wide in some cases. Such padded safety barriers are typically secured to the steel frame by straps, clips, hook and loop fasteners or the like to ensure that the springs and part of the jumping mat inwards from the edges are well covered for the protection of jumpers using the trampolines.

It will be appreciated that the safety padding interferes with movement of persons from one trampoline mat to the adjacent trampoline mat because safety padding is not intended to be jumped on to produce a bounce but rather to protect a person who misses the mat and accidentally lands on the spring space. Although the non-jumping regions are padded, the arrangement effectively limits the park to individual trampolines which, although close to one another, must necessarily be used as individual trampolines with a single jumper on each mat.

Trampolines have been developed which use leaf springs extending upwards from a frame resting on or supported above the ground and curving inwards or outwards to connect to the jumping mat. Such trampolines are not commonly known in the art, but seem to provide relatively good performance characteristics and can be arranged so that the leaf springs along the edge of one mat are each interposed between the leaf springs along the adjacent edge of an adjoining mat as described in our co-pending international patent application No. PCT/AU2015/000398. However, the bounce characteristics on the join itself may not be optimum.

Additionally, where coil springs are used for joining adjacent mats to each other with padding supporting the spring from below, expansion and contraction of the spring tends to saw through the padding with the result that the padding requires frequent replacement. Adjacent jumping mats are joined indirectly edge-to-edge to each other with an extensible joining strip fastened along each longitudinal edge to the edge of the jumping mat, the jumping mat being made of a substantially inextensible material of the kind typically used for traditional trampolines. The joining strip is typically formed from elastane or similar stretchable textile material.

As such, an improved mat connection system that overcomes one or more of the deficiencies of the prior art, such as those previously described, is required.

SUMMARY

The present invention is aimed to providing trampolines and connectors for trampolines whereby the trampolines and trampoline mats of adjacent or adjoining trampolines may be connected to one another for use, for example in a trampoline park. The invention also aims to address some of the issues arising from the arrangements of previously developed systems which work well, but may be prone to breakage or require frequent replacement of wear parts.

By way of example, our co-pending international patent application No. PCT/AU2016/051013 describes a trampoline park which uses hoop springs in a preferred arrangement to eliminate the non-bouncing regions between adjacent jumping mats and provide superior bounce compared to a version which uses leaf springs. However, it has been found that the hoop springs can suffer from mechanical failure over time. Additionally, it may be difficult to set or alter the spring parameters or resting tension of the hoop springs described in this application so as to provide optimum bounce characteristics at a joint portion between two adjacent jumping mats.

In view of the above, the present invention broadly relates to a hoop spring assembly and mat connection systems and trampolines including same. The invention has particular application to connecting adjacent trampolines side-by-side with the adjacent edges of the jumping mats joined to provide an effectively continuous jumping mat by providing resilient support along the joint portions thereof. The invention may also have application to trampolines having a single mat or "stand alone" trampolines.

In addition to the above, the present inventor has invented trampolines and trampoline systems which do not necessarily require horizontal coil springs between adjacent mats. Rather, the mats are connected to each other such that they effectively form a continuous mat and the joint lines are supported by leaf springs formed into a cylinder or something like a cylinder as can be seen in PCT/AU2015/000398 which is incorporated herein in its entirety by way of reference.

While the trampolines described therein are superior to earlier trampoline systems and will provide significant advantages in trampoline parks, the present inventor has found that the bounce in the region of the mat joints is particularly good and has now invented a trampoline for use particularly in trampoline parks which has improved bounce characteristics away from the joint regions.

In one aspect, the invention provides a hoop spring assembly for use in a mat connection system of a trampoline, the hoop spring assembly comprising:

a first hoop portion and a second hoop portion hingedly and operably connected by a pair of laterally positioned hinge members which each define a pivot point therebetween; and a resilient member operably connected to each of the pair of hinge members and extending therebetween.

In one embodiment, the resilient member extends across the hoop spring assembly substantially between the hinge members.

In one embodiment, each of the first and second hoop portions comprise a leaf spring.

In certain embodiments, the resilient member comprises a coil spring. In alternative embodiments, the resilient member comprises an elastic member, such as an elastic strip or band.

Suitably, the resilient member is operably connected to each of the hinge members by a pair of respective retaining members, such as loop members. Preferably, each of the loop members is pivotably connected to their respective hinge member and extends inwardly therefrom. Preferably, each of the loop members comprise a pair of arms pivotably connected to their respective pivot point and a retaining bar extending perpendicularly therebetween.

Suitably, a resting tension of the resilient member is adjustable. To this end, the position of the retaining bar relative to the arms is preferably adjustable. More preferably, each of the arms comprises a series of two or more opposed apertures spaced therealong for receiving the retaining bar therethrough.

In another aspect, the invention provides a hoop spring assembly comprising:

a first hoop and a second hoop, the first hoop disposed angularly within the second hoop and engaged thereto at a base portion thereof; and a first resilient member disposed within the first hoop and extending between lateral portions of the first hoop so as to be operably connected thereto.

In one embodiment, the hoop spring assembly further comprises a second resilient member disposed within the second hoop and extending between lateral portions of the second hoop so as to be operably connected thereto.

In certain embodiments, the first hoop is disposed substantially perpendicularly within the second hoop.

In particular embodiments, one or both of the first and second hoops comprise a pair of opposed flange portions extending inwardly from the respective lateral portions thereof, the flange portions configured to engage the respective end of their respective resilient member.

Suitably, one or both of the first and second resilient members comprises a coil spring.

In a further aspect, the invention provides a mat connection system for connecting adjacent jumping mats of a trampoline, the mat connection system comprising:

a hoop spring assembly connected to a frame of the trampoline and underlying a joint portion between first and second jumping mats, the hoop spring assembly according to that of the first and second mentioned aspects.

Suitably, the mat connection system further comprises a spring member disposed between the first and second jumping mats and operatively connected thereto for biasing the first and second jumping mats towards each other. Preferably, the spring member comprises a coil spring.

In one embodiment, the spring member is at least in part disposed within a housing.

Suitably, the mat connection system further comprises a resilient cover layer configured for covering the joint portion between the first and second jumping mats. Preferably, the cover layer is adapted to facilitate relative lateral displacement of the first and second jumping mats upon extension and retraction of the spring member.

In certain embodiments, the mat connection system further comprises upper and lower protective layers between which is disposed the spring member.

In one embodiment, the mat connection system further comprises an intermediate layer disposed between the cover layer and the upper protective layer that engages the first and second jumping mats and extends therebetween.

In another embodiment, the first and second jumping mats each further comprise a skirt extending from a respective end portion thereof so as to be disposed between the intermediate layer and the upper protective layer.

In one embodiment, the mat connection system further comprises a spring support disposed adjacent and underlying a base portion of the hoop spring assembly and extending circumferentially partly therearound. The spring support suitably comprises a further leaf spring.

In one embodiment, the mat connection system further comprises a resiliently compressible portion disposed between the lower protective layer and the hoop spring assembly.

In yet another aspect, the invention provides a trampoline system comprising:

a frame;

a plurality of jumping mats, including first and second jumping mats; and the mat connection system of the aforementioned aspect for operatively connecting the plurality of jumping mats at respective joint portions therebetween.

In yet a further aspect, the invention provides a trampoline comprising:

a frame;

a jumping mat; and the hoop spring assembly according to the first and second mentioned aspects connected to the frame and being disposed below the jumping mat so as facilitate biasing the jumping mat upwards.

In another form, the biasing means includes a coil spring formed from winding a flat resilient material into a spirally coiled, single pitch helix with its axis parallel to the join between adjacent jumping mats. In another form, the biasing means includes one or more inflatable vessels, preferably formed from elastically resilient material.

With the foregoing in view, the invention in one aspect resides broadly in a trampoline or trampoline system including:

a frame or other foundation;

biasing means mounted to said frame or other foundation; and a jumping mat connected to selected first ones of said biasing means respectively above said frame or other foundation in side by side relationship, said selected first ones of said biasing means being arranged to bias said mats outwards to tension said mats, and said plurality of mats being operatively connected to each other along respective adjacent portions thereof, and selected second ones of said biasing means including means for translating substantially vertical motion to resiliently biased non-vertical motion to bias said mats upwards; and adjacent mats being connected to each other along adjacent portions thereof by selected third ones of said biasing means arranged to bias adjacent mats towards each other.

In another aspect, the invention resides broadly in a trampoline or trampoline system including:

a frame or other foundation;

biasing means connected to said frame or other foundation and extending therefrom;

a plurality of jumping mats operatively connected to each other along respective connecting portions thereof and/or to selected first ones of said biasing means respectively above said frame in side by side relationship, said selected first ones of said biasing means being arranged to bias said plurality of mats outward to tension said mats and said plurality of mats being supported by selected second ones of said biasing means along their respective connecting portions, said second ones of said biasing means including means for translating substantially vertical motion to resiliently biased non-vertical motion to bias said plurality of mats upwards; and said adjacent mats being operatively connected to each other by other biasing means extending from the connecting portion of one mat to the adjacent connecting portion of the adjacent mat so as to bias adjacent mats towards each other.

In another aspect, the present invention resides broadly in a trampoline or trampoline system including:

a frame or other foundation;

first and second biasing means mounted on or to said frame or other foundation;

a plurality of jumping mats operatively connected to each other in side by side relationship along respective adjacent portions thereof to provide a substantially continuous or semi-continuous mat, the continuous or semi-continuous mat being connected to said first biasing means above said frame or foundation about its periphery and said first biasing means being arranged to bias said continuous or semi-continuous mat outward;

said second biasing means being arranged to support said continuous or semi-continuous mat above said frame or foundation at selected locations spaced inward from said periphery, the second basing means including means for translating substantially vertical motion to resiliently biased non-vertical motion; and the adjacent mats or mat segments being connected to each other by third biasing means arranged to bias adjacent mats or mat segments towards each other.

In another aspect, the present invention resides broadly in a trampoline or trampoline system including a plurality of jumping mats supported in spaced relationship from a floor or ground by first biasing means for biasing said plurality of jumping mats outward for operative support by peripheral support means, each jumping mat being substantially inextensible and having a plurality of peripheral edges, at least one of said peripheral edges being a joining edge adapted to be joined to the joining edge or joining edges of one or more other jumping mats by joining means, the joining means being supported above the ground or floor by second biasing means, the joining means including:

third biasing means interposed between the joining edges for biasing the joining edges towards one another;

an extensible cover portion for covering the third biasing means and an edge portion of each joining edge; and protection means above and below said third biasing means for protecting said third biasing means from wear against said second biasing means.

In another aspect, the present invention resides broadly in a trampoline or trampoline system including:

a frame or other foundation;

first and second biasing means mounted on or to said frame or other foundation;

a plurality of jumping mats operatively connected to each other in side by side relationship along respective adjacent portions thereof to provide a substantially continuous or semi-continuous mat, the continuous or semi-continuous mat being connected to said first biasing means above said frame or foundation about its periphery and said first biasing means being arranged to bias said continuous or semi-continuous mat outward;

said second biasing means including means for translating substantially vertical motion to resiliently biased non-vertical motion and arranged to support said continuous or semi-continuous mat above said frame or foundation at selected locations spaced inward from said periphery; and wherein padding is interposed between the second biasing means and the continuous or semi-continuous mat, said padding including locating means adapted to engage said second biasing means at said selected locations to hold said padding in a predetermined position.

In another aspect, the present invention resides broadly in a trampoline or trampoline system including:

a frame or other foundation;

first and second biasing means mounted on or to said frame or other foundation;

a plurality of jumping mats operatively connected to each other in side by side relationship along respective adjacent portions thereof to provide a substantially continuous or semi-continuous mat, the continuous or semi-continuous mat being connected to said first biasing means above said frame or foundation about its periphery and said first biasing means being arranged to bias said continuous or semi-continuous mat outward;

said second biasing means being arranged to support said continuous or semi-continuous mat above said frame or foundation at selected locations spaced inward from said periphery and including means for translating substantially vertical motion to resiliently biased non-vertical motion; and wherein padding is interposed between the second biasing means and the continuous or semi-continuous mat, said padding including locating means adapted to engage said second biasing means at said selected locations to hold said padding in a predetermined position.

In another aspect, the present invention resides broadly in a spring arrangement for resiliently supporting adjoining mats of a trampoline park, including means for translating substantially vertical motion to resiliently biased non-vertical motion.

In one embodiment, the spring arrangement or second biasing means includes one or more arcuate leaf springs and one or more resilient connection means pivotally connected to each end of the leaf spring or leaf springs directly or indirectly across the chord extending between the ends.

In one particular embodiment, the resilient connector is or comprises a coil spring. In a further preferred form, the resilient connector connects the ends of two leaf springs which together form a circular or lenticular hoop hinged at the connection points with the coil spring interposed directly or indirectly between the hinges. That is to say, the coil spring suitably extends diametrically across the circle or from point to point across the biconvex or lenticular form of the spring arrangement, that lenticular form being observable when viewing the spring arrangement side on.

In an alternative embodiment, the resilient connection means includes a continuous rubber loop or band looped around rods or tubes. In a further preferred form, the resilient connection means connects the ends of two leaf springs which together form a circular or lenticular hoop hinged at the connection points with the band interposed between the hinges. That is to say, the band extends diametrically across the circle or from point to point across the biconvex or lenticular form of the spring arrangement, that lenticular form being observable when viewing the spring arrangement side on.

Alternatively, the rubber band may be a coil spring or flat serpentine spring. However, the rubber band affords the advantage that when the arcuate leaf springs are compressed to their full extent, the rubber band is not prone to damage by being squeezed or squashed flat. Upper and lower padding is provided as a buffer stop arrangement, the rubber band also making a limited contribution to the buffer stop function.

The rubber band is preferably held in place with a predetermined amount of tension, the tension being adjustable by providing a buckle connector at each end connected to the pin connecting the parts of the hinge together. The buckle connector is provided with a plurality of locations along opposed stiles at which the rod about which the band is passed may be fastened, secured or otherwise held in place.

Alternatively, the second biasing means may include a diamond-frame having four arms pivotally joined end-to-end to form a quadrilateral loop akin to a pantograph. The arms are arranged for up and down movement, but biased so that the upper pivot is at a predetermined height position when the biasing is relaxed, but is resiliently resistant to being lowered by one or more springs or spring arrangements interconnecting opposed pivots of the pantograph. Moreover, the second biasing means may be constructed as one of several combinations or permutations of the leaf spring plus chord arrangement and the pantograph arrangement. Springs may be attached to the arms or other springs generally to achieve the aim of resiliently supporting the trampoline mat. Hereinafter, these arrangements, along with the preferred arrangement, will be referred to as a spring assembly.

In a preferred form, the tension means are provided by a plurality of coil springs extending between the adjacent edges of the adjacent trampoline mats. In a preferred form, the resilient joint support is provided by a plurality of spring assemblies each in the form of two arcuate leaf springs pivotally connected at each end to each other as well as by each end to an extensible connector extending between the ends and biasing the ends of each leaf spring towards each other. The leaf springs may also include one or more additional leaves extending part way along their length. The additional leaves may be centrally arranged between the ends on the outside of the curve.

In another aspect, the invention resides broadly in a mat connector for connecting adjacent mats of a trampoline including a plurality of mats, the mat connector including:

a housing and a connecting block;

the housing including means such as a passage for connecting a leaf spring or other biasing means to the housing, and at least one cavity, recess or passage therein for receiving the connecting block, the cavity, recess or passage opening to a lower face of the housing for connection of the edge portions of adjacent mats to be connected thereto and to at least one end face of the housing for fitting the connecting block thereto, the housing being so made and arranged as to prevent the connecting block escaping from the opening to the lower face, the connecting block, two longitudinal spaced apart passages and each longitudinal passage having an opening thereto along its length for receiving therein the edge portion of a mat.

Preferably, the mat connection assembly is adapted for use in a trampoline park. Suitably, this is by virtue of the hoop spring assemblies each being configured for translating substantially vertical motion to resiliently biased non-vertical motion, such as substantially horizontal or lateral motion, as herein described.

The mats may be connected to the mat connection system via mat connectors which hold the adjoining mats a predetermined distance above the spring assemblies. Advantageously, the configuration of the spring assemblies allows the mat portion at the join to be an active part of the mat, allowing users to jump on the connection. The configuration also allows the spring assembly to "roll", thereby providing a horizontal component of bias to the mat at the connecting edge (or join) when a person jumps on one mat as well as an upwards or vertical component of bias.

The layers of the trampoline mat connector may be formed of a material of greater elasticity than the main part of the mat in order to reduce the effect of "double bounce" from a person jumping on an adjacent mat. It is believed that the elastic material selected should approximate as closely as possible spaced apart horizontal coil springs along the length of the connecting portions. The layers preferably include the cover portion, the third biasing means and the protection means hereinbefore described.

The cover portion is formed from an elastomeric or elastane-like material capable of stretching without significant resistance, and contract again when the third biasing means contracts. The material is also preferably selected to feel as close as possible to the feel of the material of the jumping mat when jumping on the joint between adjacent trampolines. The selection is made so that in combination with the other materials forming the mat connector or mat joiner the jumper can comfortably jump on the join.

The third biasing means may be a coil spring, a flat serpentine spring or rubber band type material. The protection means preferably includes an upper pad interposed between the cover portion and the third biasing means and a lower pad interposed between the third biasing means and the second biasing means.

In another aspect, the invention resides broadly in a trampoline including:

a frame and/or mount;

biasing means connected to said frame and/or mount and extending therefrom; and a plurality of jumping mats operatively connected to each other along respective connecting portions thereof and/or to selected first ones of said biasing means respectively in side by side relation, said selected first ones of said biasing means being arranged to bias said plurality of mats outwards to tension said mats and said plurality of mats being operatively connected to selected second ones of said biasing means, said second biasing means being arranged to bias said plurality of mats upwards and wherein at least some of said selected second biasing means are arranged between adjacent connecting portions and spaced therefrom.

Preferably, selected ones of said second biasing means are arranged along the respective connecting portions to bias said plurality of mats upwards along those portions while the others are arranged to bias the mats upwards at selected lines, points or regions between the connecting portions.

In one form of the invention, the second biasing means are formed in an array of rows of leaf springs. Preferably, the array comprises intersecting rows of leaf springs and preferably such rows are arranged with some running in one direction and some in an orthogonal or perpendicular direction. However, in another form, where the mats are circular, it is preferred that some rows be circular and some radial from the centre of the middle mat and intersecting the circular rows.

In one form where the mats are rectangular it is preferred that the second biasing means along the connecting portions be leaf springs in loop form spaced apart and coaxial under the connecting portion. In such form, it is also preferred that each of the second biasing means between connecting portions (intermediate biasing means) be a combination of at least two leaf springs in loop form with the leaf springs being angularly spaced from each other and preferably concentric or near concentric. However, the intermediate biasing means in such form can be combined with any other desired second biasing means along the connecting portions although probably to less advantage.

In another aspect, the invention resides broadly in a trampoline including:

a frame and/or mount;

biasing means connected to said frame and/or mount and extending therefrom; and a plurality of jumping mats operatively connected to each other along respective connecting portions thereof and/or to selected first ones of said biasing means respectively in side by side relation, said selected first ones of said biasing means being arranged to bias said plurality of mats outwards to tension said mats and said plurality of mats being operatively connected to selected second ones of said biasing means along their respective connecting portions, said second biasing means being arranged to bias said plurality of mats upwards, said mats also being supported by selected third ones of said biasing means between adjacent connecting portions and spaced therefrom.

As mentioned previously, it is preferred that said second ones of said biasing means each comprise a leaf spring forming a loop. In such form it is preferred that such loop be closed at the top adjacent the mat and connect to the frame or mount at the bottom which might be a concrete floor or wall or a member connected the outer frame or as separate frame. In other words, in such form, the leaf spring has two opposed ends which connect to the frame and from which the leaf spring extends outwards and upwards for a predetermined distance and then upwards and inwards to form a leaf spring of substantially cylindrical form ("the cylindrical leaf springs"). In some forms of the invention, the cylindrical leaf springs can be continuous leaf springs formed into a helix or spiral so that each loop does not have free ends and the only free ends at the ends of the helix.

Performance of the mats is improved by ensuring that the mat is secured to each loop spring which in turn is secured to the frame or mount against relative translator movement the cylindrical leaf springs can "roll" by deforming the cylindrical shape and thereby providing a horizontal component of bias to the mat at any point of connection when a person jumps on one mat as well as an upwards or vertical component of bias. While the mats still perform reasonably well where the mats are loosely connected to the cylindrical leaf springs, performance is better where the mat is connected in a manner whereby the upper portion of the loop has to move with the mat in whatever direction it is pulled thereby applying the desired horizontal bias. The combination of two or more loop springs to form second biasing means is such as to provide a biasing force in any horizontal direction at the point of connection to the mat.

It will be appreciated that the leaf spring performance can be changed or altered by having multiple leaves or different numbers of leaves in some parts. Additionally, in one form, of the cylindrical leaf spring an extension coil spring is connected to opposite sides of the cylinder which is horizontal in use to increase the spring constant at the mid portions of the cylindrical leaf spring instead of adding leaves at the place.

The term "leaf spring" used herein is generally intended to refer to leaf springs having a rectangular cross section. However, it is to be understood that leaf springs of other cross section which might not generally be considered as "leaf springs" are intended to be included within the scope of that term, unless clearly not appropriate. For example, leaf springs of square cross section or round cross section which are capable of carrying out the equivalent function of the leaf springs described and illustrated are herein referred to as "leaf springs".

The present invention lends itself to banks of trampoline mats of different polygonal shapes, particularly hexagonal mats which provide for better support in the corners than square or rectangular trampolines. In such form, it is preferred that the mats be joined by trampoline mat connectors according to the present invention.

BRIEF DESCRIPTION OF THE DRAWINGS

In order that the invention may be more readily understood and put into practice reference will now be made to the accompanying drawings illustrating a preferred embodiment of the invention along with some aspects of the prior art and wherein.

DETAILED DESCRIPTION

Figure 1:
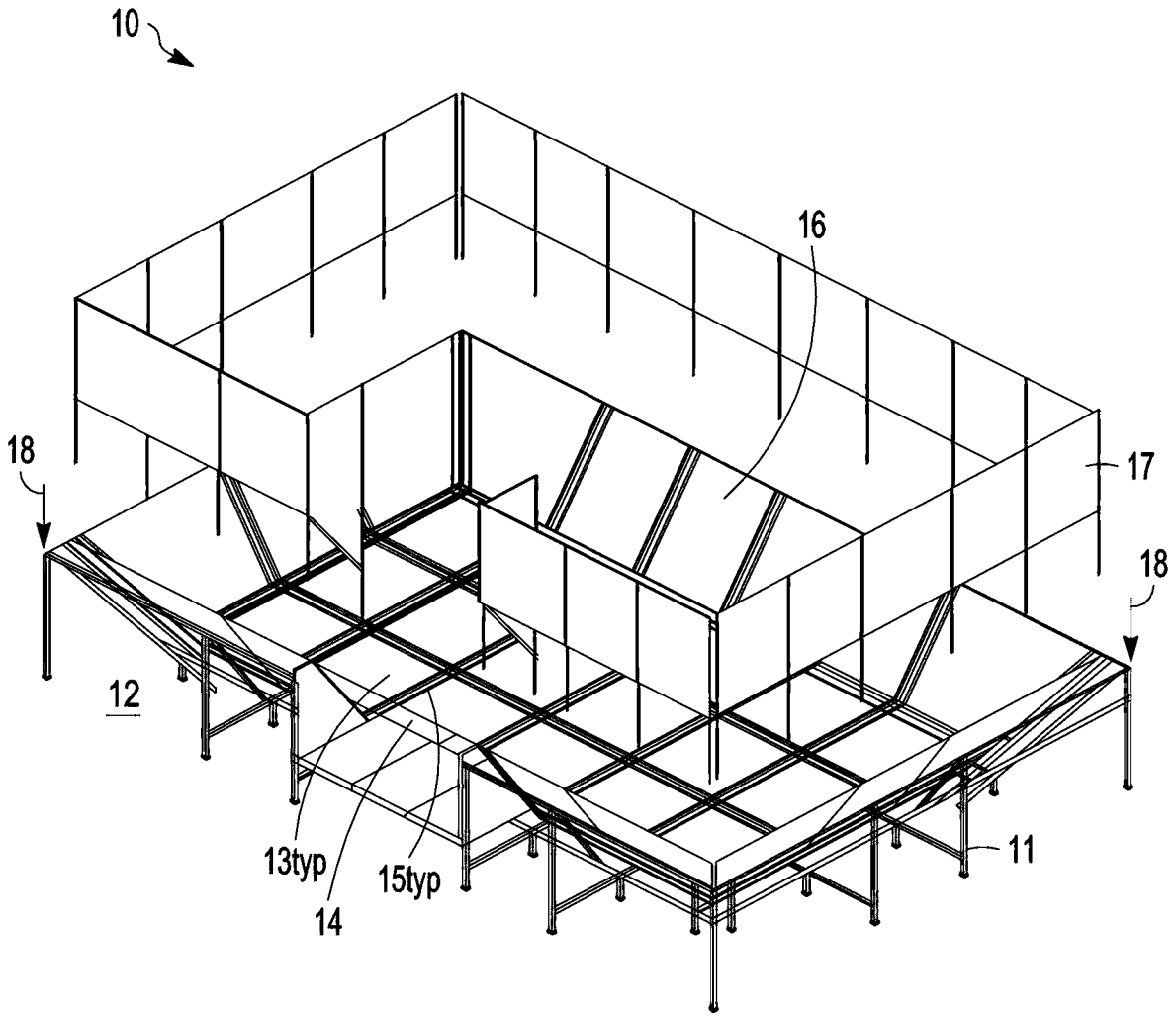
FIG. 1 is a pictorial and partly exploded view of a trampoline park having a mat connection system according to the invention.

A trampoline park 10 is illustrated in FIG. 1 and may also be considered a trampoline system, trampoline field or trampoline park or for use in a trampoline park. The trampoline park 10 includes a frame 11 supported on or extending above a floor 12 or other foundation. A plurality of biasing members are mounted on or to the frame 11 as hereinafter described in more detail.

A plurality of jumping mats is shown typically at 13, each jumping mat 13 being connected to a first set of biasing members 14 above the frame 11 in side by side relationship, the first set of biasing members 14 being arranged or disposed around the periphery of the plurality of jumping mats 13 to bias the plurality of jumping mats 13 outwards to afford tension thereto.

Further to the above, the plurality of jumping mats 13 are operatively connected to each other along respective joint portions thereof shown typically at 15. Disposed or positioned below the joint portions 15 are a second set of biasing members (not shown), which are mounted on or to the frame 11 therebelow. At the joint portions 15, adjacent jumping mats 13 are further connected to each other along their respective adjacent outer portions by a third set of biasing members (not shown), which are arranged to bias said adjacent jumping mats 13 towards each other. The second set of biasing members are located below the third set of biasing members and the joint portions 15 between the mats 13 as described in more detail in respect of FIGS. 2 to 11.

An oblique wall 16 surrounds most of the trampoline park and having an opening in one side so as to allow access thereto. The oblique wall 16 is also formed of a plurality of jumping mats 15 supported and connected in a similar arrangement as previously described, but at an oblique angle extending upwards and outwards from an edge of the trampoline park 10. A safety wall or net 17 is mounted on or to an upper edge of the oblique wall 16. In FIG. 1, the safety net 17 is shown exploded from the remainder of the trampoline park 10, but it would be appreciated that in use, the safety net 17 is mounted to and extends substantially upward from the upper edge of the oblique wall 16. That is to say, in the illustration shown, the exploded view of the trampoline park 10 may be reassembled by notionally moving the safety net 17 downwards in the direction of arrows 18 to sit atop the oblique wall 16.

Figure 2:
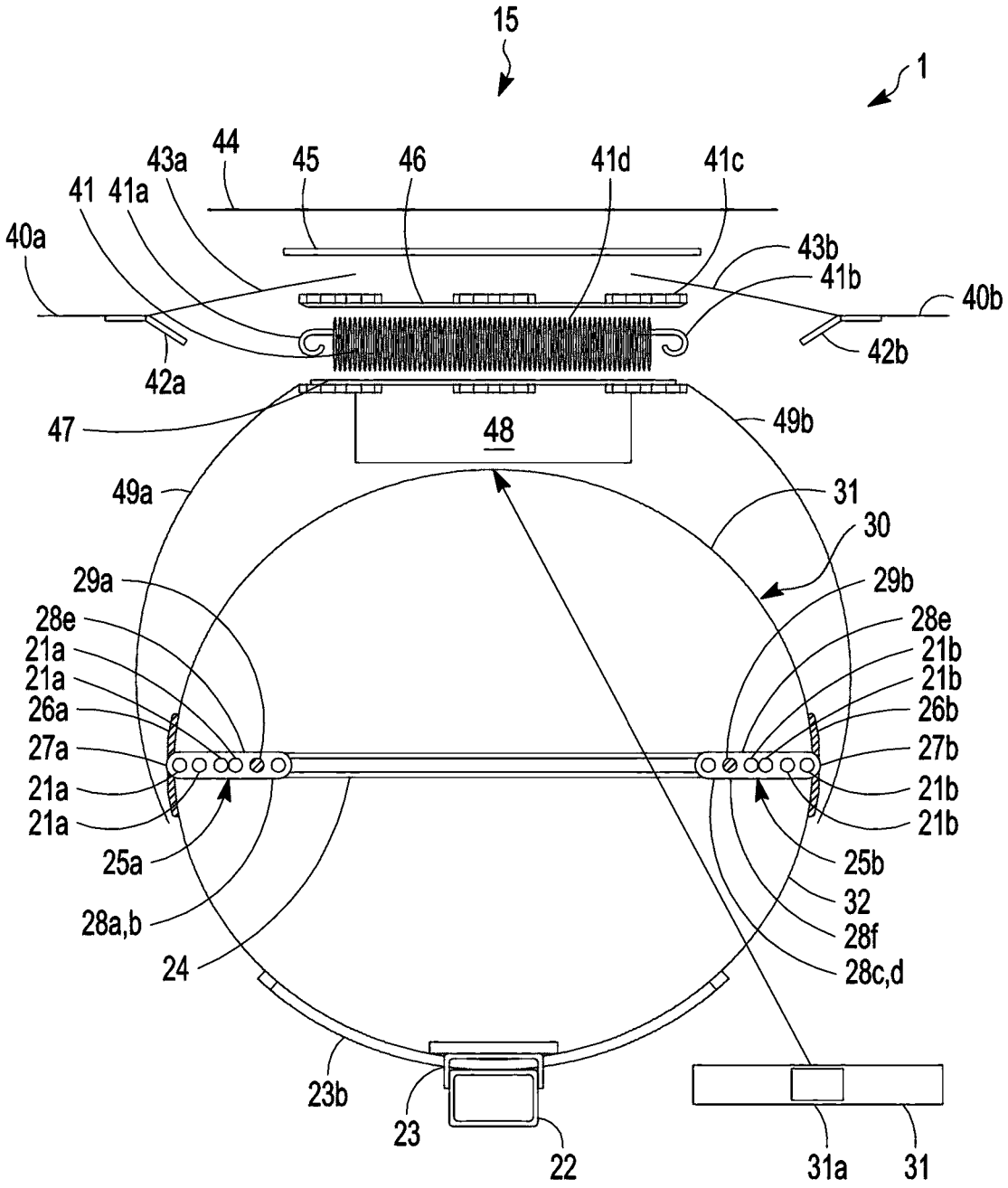
FIG. 2 is a cross-sectional view of an embodiment of a mat connection system of the invention.
Figure 3:
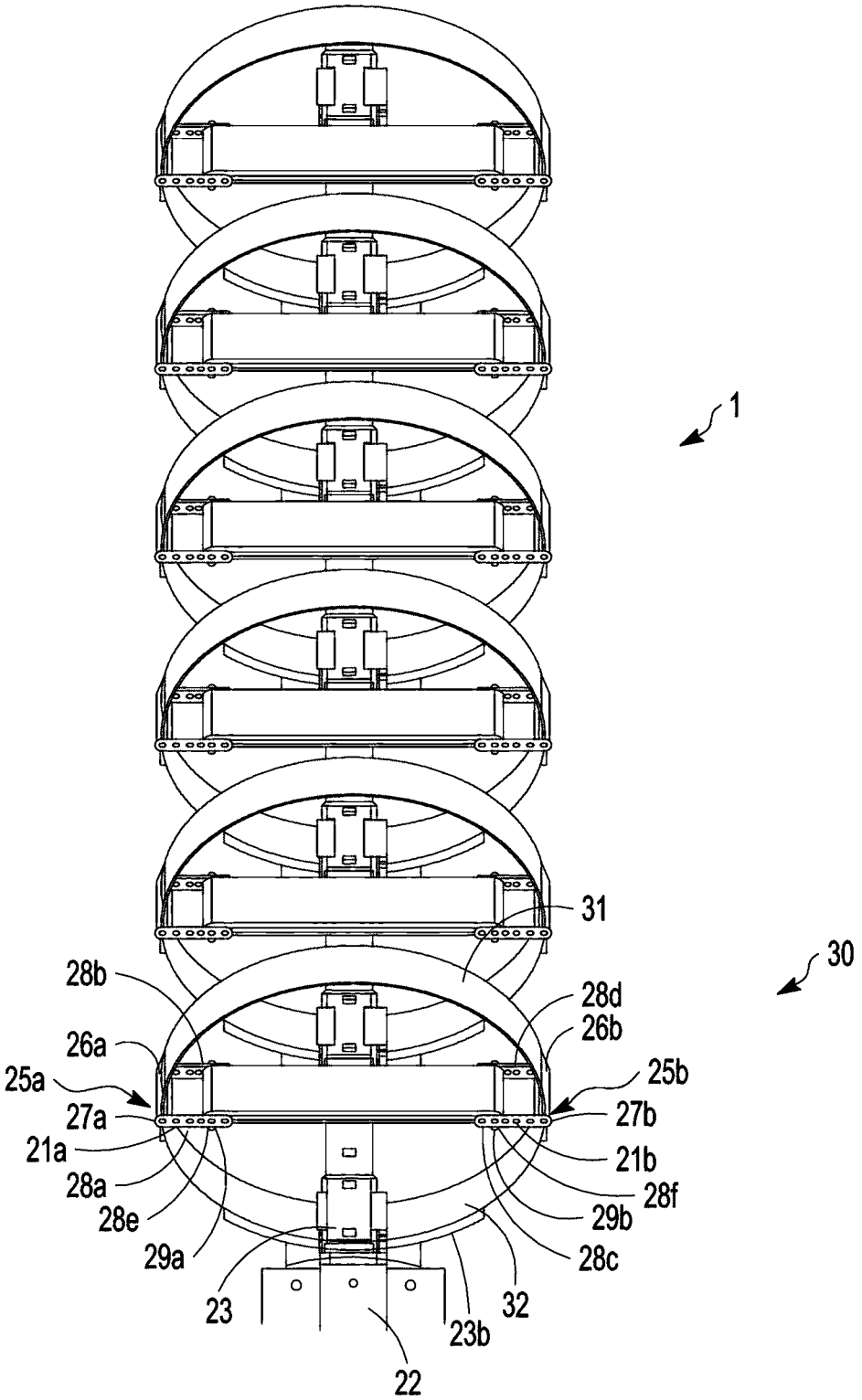
FIG. 3 is perspective view of the mat connection system of FIG. 2.
Figure 4:
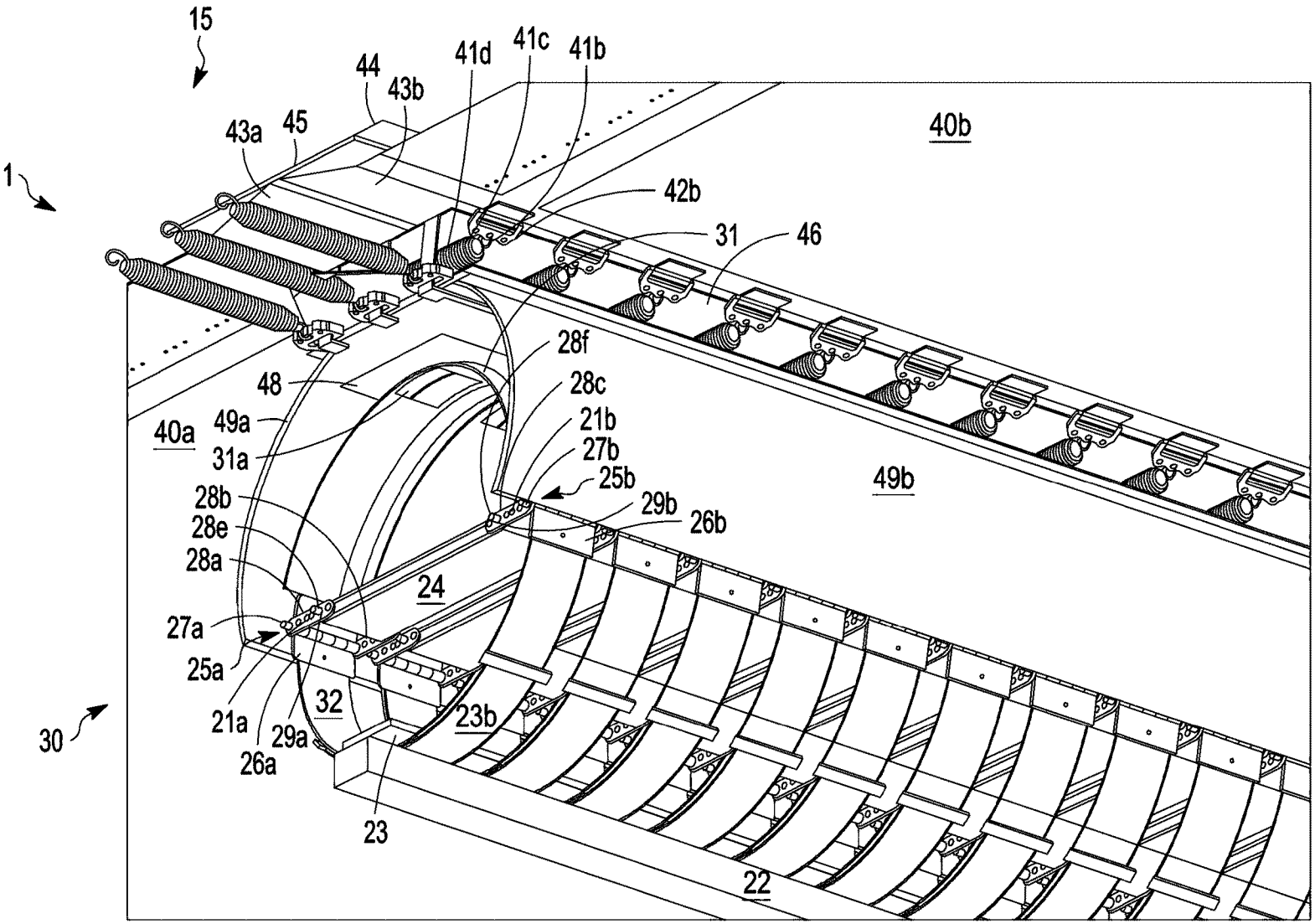
FIG. 4 is a further perspective view of the mat connection system of FIG. 2.

An embodiment of a mat connection system 1 is illustrated in FIGS. 2 to 4. Similar to the other embodiments described herein, the mat connection system 1 is designed for not only connecting and biasing two adjacent mats together, but also providing bounce characteristics similar to that of a trampoline at a joint portion 15 therebetween. As shown in FIG. 2, the mat connection system 1 includes a second set of biasing members comprising a plurality of hinged hoop spring assemblies 30. As illustrated in FIGS. 3 and 4, each of the hoop spring assemblies 30 are substantially regularly spaced axially along the frame 11 so as to define a hoop spring axis.

As illustrated in FIG. 2, the hoop spring assembly 30, comprises a first curved or hoop portion 31 and a second curved or hoop portion 32 hingedly and operably joined by a pair of laterally positioned hinge members 26*a,b* at respective first and second ends of the hoop portions 31, 32. In this regard, the hinge members 26*a,b* define a pair of respective and diametrically opposed pivot points 27*a,b*. The hinge assemblies 26*a,b* function to facilitate hinged movement of the hoop portions 31, 32 relative to each other and about the pivot points 27*a,b* upon a person jumping on the junction point 15 beneath which the mat connection system 1 is disposed. Preferably, one or both of the first and second hoop portions 31, 32, are or comprise a leaf spring. From FIG. 2, it can be observed that the hoop spring assembly 30 is supported on a cross member 22 of the frame 11 and engaged thereto so as to be held in a substantially stable position in respect of the cross member 22 by a locking plate 23. In order to provide some protection, each of the first and second hoop spring portions 31, 32 are preferably encased in a sleeve of textile material (not shown). As shown in FIG. 2, a cut-out 31*a* is provided on a lower face of the spring sleeve encompassing the first hoop portion 31.

The hoop spring assembly 30 may be formed by any means known in the art, such as bending a length of spring steel or a similarly resilient material until the leaf spring thus being formed is in of a substantially semi-circular, arcuate or curved form.

The mat connection system 1 further includes a leaf spring support 23*b* in the form of a further curved leaf spring that is disposed adjacent and underlying a lower or base portion of the second hoop portion 32 and extends circumferentially partly therearound and proximate thereto.

The hoop spring assembly 30 further comprises a laterally disposed or arranged continuous resilient or elastic loop or band 24 engaged to a pair of opposed retaining assemblies 25*a,b* and operably disposed therebetween so as to be arranged in a substantially diametrical disposition across the hoop spring assembly 30.

Each of the retaining assemblies 25*a,b* comprise a pair of planar arms 28*a-d* that are pivotably connected to the pivot point 27*a,b* of their respective hinge member 26*a,b* and extend inwardly therefrom into the central space defined by the hoop spring assembly 30. Extending perpendicularly through and between opposing apertures 29*a,b* in each of the planar arms 28*a-d* is a retaining bar 28*e,f*, which is reversibly fastened thereto by a pair of fastening elements, such as screws, nuts or the like.

As illustrated in FIGS. 2-4, the elastic band 24 extends around each of the retaining bars 28*e,f*, so as to maintain the elastic band 24 at an appropriate tension desired by a user. In order to alter the tension of the elastic band and therefore the bounce characteristics of the mat connection assembly 1, the position of the retaining bar 28*e,f* with respect to the retaining assembly 25*a,b* may be altered by virtue of the presence of a linear arrangement of further apertures 21*a,b* spaced along the length of each of the planar arms 28*a-d*. By way of example, the resting tension of the elastic band 24 may be increased by moving one or both of the retaining bars 28*e,f* to the further aperture 21*a,b* of the planar arm 28*a-d* closer to their respective hinge assembly 26*a,b*.

As illustrated in FIGS. 2 and 4, a first jumping mat 40*a* is connected to a first hooked portion 41*a* of a first end of a coil spring member 41 by way of a loop-shaped first mat connector 42*a*, such as a mat shackle. Similarly, a second jumping mat 40*b* is connected or engaged to a second hooked portion 41*b* of a second end of the coil spring member 41 by way of a loop-shaped second mat connector 42*b*. The first and second mat connectors 42*a,b* are fastened or stitched along the respective lateral side edges of the first and second jumping mats 40*a,b* so as to be configured to attach to the first and second ends of the coil spring member 41. By virtue of this arrangement, the first and second jumping mats 40*a,b* are effectively and operably joined together as well as being biased towards each other so as to impart tension to each of the mats 40*a,b*.

The mat connection system 1 illustrated in FIG. 2 further comprises a cover layer 44, which extends axially as a strip of extensible spandex material or the like overlying the junction point 15. The cover layer 44 has a width sufficient for covering the coil spring member 41 and an edge portion of each of the adjacent first and second jumping mats 40*a,b*. Preferably, the cover layer 44 is of a material or adapted to resiliently accommodate lateral relative displacement of the first and second jumping mats 40*a,b* towards and away from each other upon extension and retraction of the coil spring member 41 during use of the trampoline.

Directly underlying and proximate the cover layer 44 is provided above an intermediate layer 45 formed from a strip of carpet or similar textile material. The intermediate layer 45 is attached along respective outer edge portions thereof to an upper surface portion of each of the respective jumping mats 40*a,b* by a fastener, such as a hook and loop or velour crochet fastener or the like. As can be seen from FIG. 2, the intermediate layer 45 is disposed between the cover layer 44 and an upper protective layer 46 which in turn is laid out above the coil spring member 41 which, as previously described, extends laterally between the adjacent jumping mats 40*a,b*. The upper protective layer 46 functions at least in part to protect users from contacting the underlying coil spring member 41, and as such may be formed from any durable textile material or the like.

An extension skirt or flap 43*a,b*, which may be considered as lapping strips or the like, extends outwardly or laterally from a respective end portion of each of the first and second jumping mats 40*a,b* so as to be disposed between the intermediate layer 45 and the upper protective layer 46. Although the extension flaps 43*a,b* are shown in FIG. 2 as extending only partway between the intermediate layer 45 and the upper protective layer 46, it is preferred that they each extend further inwardly or centrally of the mat connection system 1 and may even overlap each other by extending between the intermediate layer 45 and the upper protective layer 46. A lower protective layer 47 is further provided which is disposed between the coil spring member 41 and a resiliently compressible portion 48 in the form of a foam pad. As can be seen in FIG. 2, the resiliently compressible portion 48 is operably disposed between the lower protective layer 47 and the first hoop portion 31 so as to facilitate the transfer of upward and downward bounce forces therebetween.

The lower protective layer 47 also includes a skirt portion 49*a,b* extending laterally from each side edge thereof. As shown in FIG. 2, the skirt portion 49*a,b* extends downwardly toward the hoop spring assembly 30, such that the free ends thereof reach beyond the respective hinge assemblies 26*a,b*. In the embodiment provided, the skirt 49*a,b* is formed from jumping mat material, although any suitable material known in the art is contemplated. The skirt 49*a,b* is attached to an upper surface of the lower protective layer 47 to prevent or decrease wear on the lower protective layer 47 whilst also functioning as a protective curtain for the hoop spring 30.

A body portion 41*c* of the coil spring member 41 is substantially encased in a cylindrical and corrugated housing or protector 41*d*. The cylindrical protector 41*d* is preferably comprised of a suitable plastic material that prevents or limits contact or impact between the coil spring member 41 and the respective overlying and underlying upper and lower protective layers 46, 47 upon a user bouncing on the respective joint portion 15 of the trampoline 10. Accordingly, the protector 41*d* prevents or inhibits the sawing action of the coil spring member 41 upon the upper and/or lower protective layers 46, 47 upon contact therewith.

The upper and lower protective layers 46, 47 are suitably made from a double layer of resilient textile material, such as jumping mat material, in order to provide an additional layer of support and protection from the coil spring member 41 for a user and distribute their weight across a larger surface area upon bouncing on the respective joint portion 15. It is intended that such an arrangement affords a more level and cushioned bounce when jumping on the joint portion 15. Further, the resiliently compressible portion 48 is provided for additional cushioning and to increase the distance between the cover layer 44 and the first hoop portion 31. It is intended that such an arrangement increases safety to a user and affords a substantially obstruction-free bounce.

Figure 5:
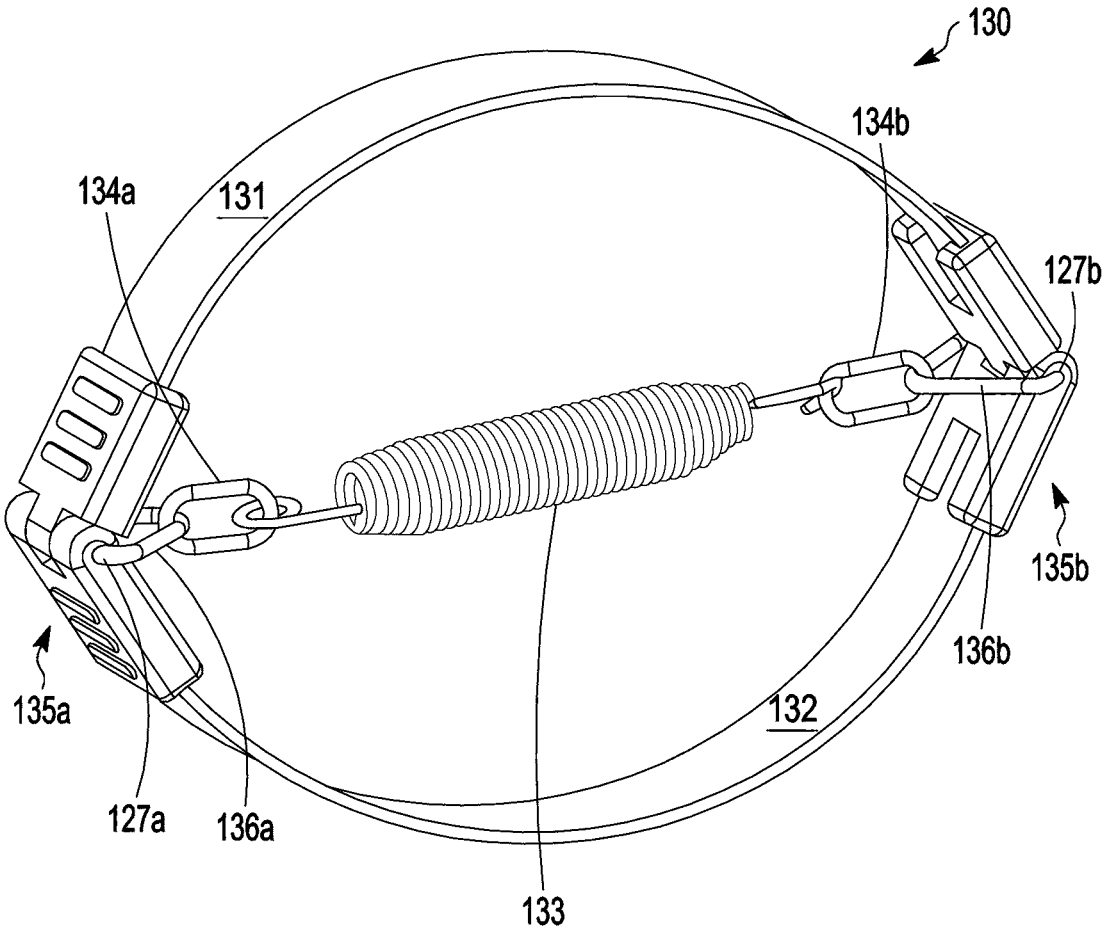
FIG. 5 is a side view of an embodiment of a hoop spring assembly for resiliently supporting adjoining mats of the trampoline park of FIG. 1.
Figure 6:
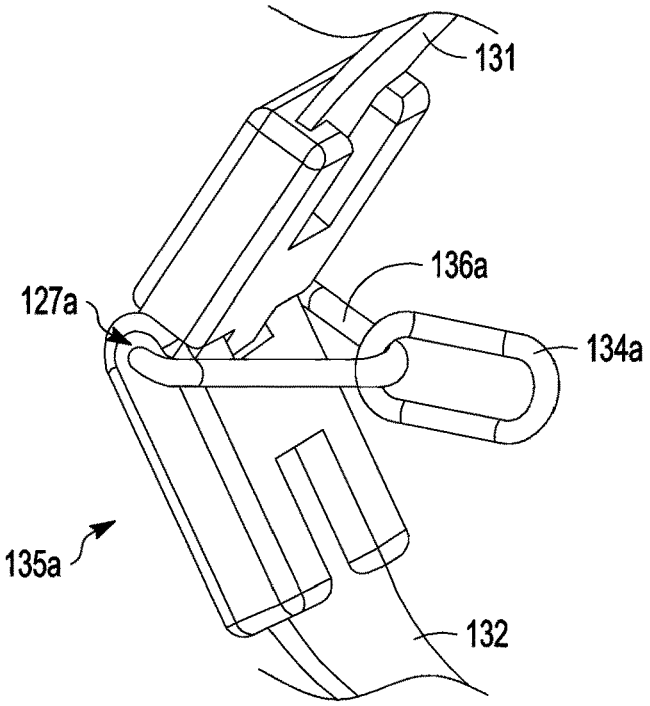
FIG. 6 is a close up perspective view of a hinge assembly for the hoop spring assembly of FIG. 5.
Figure 7:
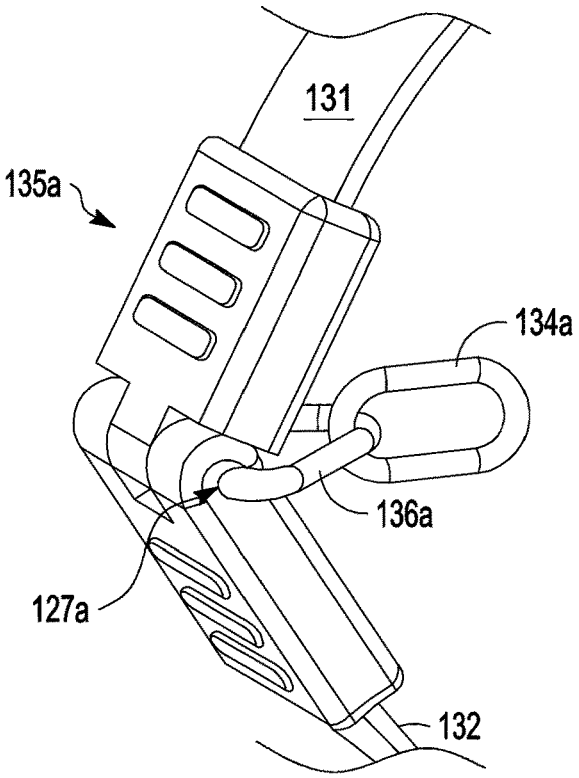
FIG. 7 is another close up perspective view of the hinge assembly of FIG. 6.

A further embodiment of a hoop spring assembly 130, which may be used in respect of the previously described mat connection system 1 as a replacement or alternative to the hoop spring assembly 30, is illustrated in FIGS. 5 to 7. The hoop spring assembly 130 includes a curved or arcuate first hoop portion 131 hingedly connected at respective free ends thereof to a similarly shaped second hoop portion 132. In the present embodiment, each of the first and second hoop portions 131, 132 comprise leaf springs and are joined at their respective free ends to each other by way of first and second hinge members 135*a,b*, so as to define a substantially cylindrical space therewithin. The hinge members 135*a,b* function to facilitate hinged movement of the hoop portions 131, 132 relative to each other and about a respective pivot point 127*a,b* defined thereby upon a person jumping on the junction point 115 beneath which the hoop spring assembly 130 is disposed.

As can be observed in FIG. 5, a coil spring member 133 extends between the opposed free ends of the first and second hoop portions 131, 132 so as to be in a substantially diametrical disposition across the hoop spring assembly 130. In this regard, the coil spring member 133 is pivotally connected to each of the hinge members 135*a,b* with at least some tension therebetween by way of respective chain links 134*a,b*. To this end, the coil spring member 133 has one of the chain links 134*a,b* at a free end thereof, with each chain link 134*a,b* being linked to its respective hinge member 135*a,b* by way of a D-link 136*a,b*. It will be appreciated, however, that alternative means of operably connecting the coil spring member 133 to each of the hinge members 135*a,b* as are known in the art are contemplated.

As can be seen in more detail in FIGS. 6 and 7, the straight portion of the D-link 136*a,b* forms the pin for the respective hinge member 135*a,b*. The combined arrangement of the hoop portions 131, 132, hinge members 135*a,b* and the coil spring member 133 facilitates the translation of vertical motion to horizontal motion due to the straightening of the curved hoop portions 131, 132 and the lengthening of the coil spring member 133 when a weight or force is applied vertically to the hoop spring assembly 130, when orientated in its normal upright orientation as illustrated in FIG. 5. The arrangement of FIG. 5 is preferred because the coil spring member 133 between the hinge members 135*a,b* may be damaged if one or both of the hoop portions 131, 132 are depressed to an extent that they may impact and possibly damage the coil spring member 133.

It will be appreciated that the previously described embodiments of the hoop spring assemblies 30, 130 may be tilted for use with the sloping or oblique walls 16 of the trampoline park 10 shown in FIG. 1. Additionally, the hoop spring assemblies 30, 130 may be used to resiliently support the peripheral edges of a trampoline in conjunction with coil springs attached to the peripheral edge of the respective mat. To this end, the hoop spring assemblies 30, 130 can extend in a substantially coplanar orientation with respect to the mat and be attached to the frame 11 in an arrangement akin to the arrangement used for prior art trampolines. In addition to the above, it will be apparent that the bounce characteristics of the associated jumping mats 15 may be altered as required by changing the characteristics or resting tension of the hoop spring assemblies 30, 130, the elastic band 24 and/or the coil spring member 133.

Figure 8:
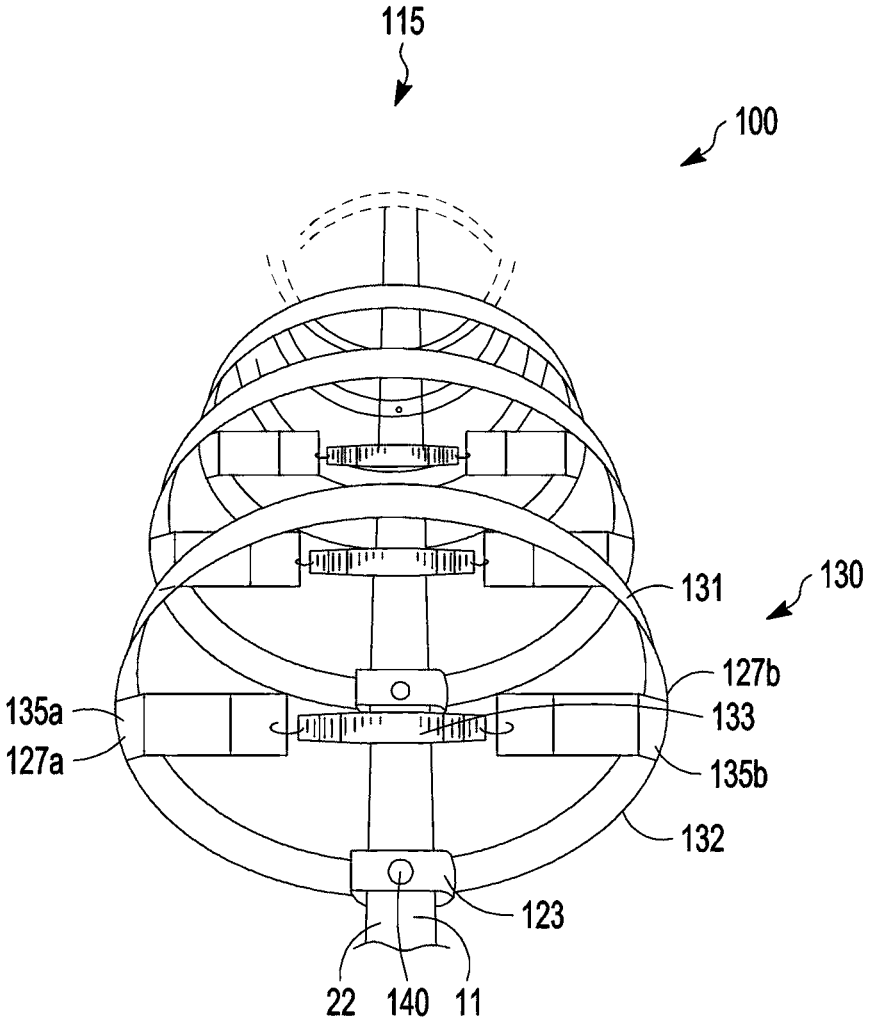
FIG. 8 is a perspective view of a series of the hoop spring assemblies of FIG. 5.

FIG. 8 illustrates a mat connection system 100 showing an arrangement of a plurality of the hoop spring assemblies 130. The mat connection system 100 includes a plurality of the hoop spring assemblies shown typically at 130 spaced substantially regularly from each other along a hoop axis and also being substantially parallel to one another. Each of the hoop spring assemblies 130 is supported or engaged at a base portion thereof to the cross member 22 of the frame 11, and being held in position in respect of the frame 11 by a fastener 140, such as a bolt or the like, and the locking plate 123.

Figure 9:
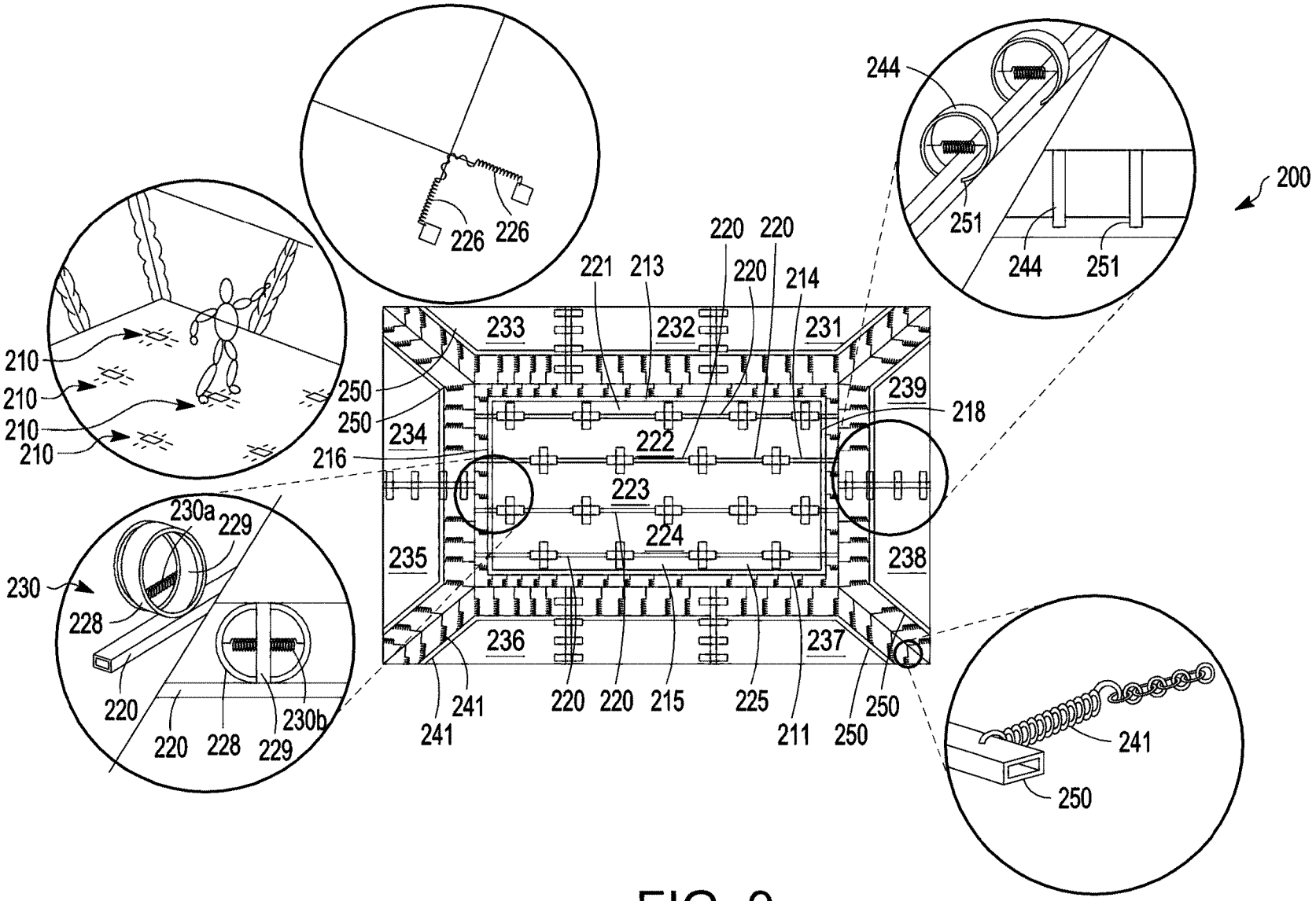
FIG. 9 is a pictorial representation of a further embodiment of a trampoline according to the present invention including a further embodiment of a hoop spring assembly.

A further embodiment of a trampoline 200 is illustrated in FIG. 9 and includes an elevated rectangular main frame 211 which is supported on spaced apart legs 212 (not shown) which are welded to the frame 211 at their upper ends, although in other versions the legs are bolted to the frame.

The frame 211 comprises two spaced apart long side upper members (or rails) 213 and 215, two spaced apart short side or end upper members (or rails) 216 and 218 extending between the side members and welded thereto adjacent their respective opposite ends, and a plurality of lower cross members 220 also extending between the short side members 216, 218 and spaced apart along their length and at a substantially lower level therefrom. Inclined frames 250 extend upwards and outwards from the main frame 211 for supporting inclined mats as will be described in more detail later.

The side members 213, 215 and the end members 216, 218 are constructed of 100 mm×50 mm rolled hollow section steel tube while the cross members 220 are constructed of 100 mm by 50 mm rolled hollow section steel tube. However, it will be appreciated that other sections and sizes and configurations could be used if desired.

Five substantially identical rectangular jumping mats 221-225 are connected to the frame 211 via a plurality of coil spring members 226 spaced apart around the perimeter of the rectangular frame 211 and an array of a further embodiment of a mat connection system 210 which are spaced apart along the joint portions 214 between adjacent jumping mats 221-225.

Each mat connection system 210 includes a hoop spring assembly 230 comprising first and second cylindrical hoop spring members 228 and 229 as can be seen in FIG. 9, with each hoop spring member 228, 229 taking the form of a single cylindrical or near cylindrical leaf spring. The hoop spring members 228, 229 are perpendicularly disposed or positioned within and with respect to each other and a pair of coil spring members 230*a,b* extends diametrically across and between each respective lateral portion thereof. As described earlier, substantially the same effect could be achieved by having multiple leaf springs in the region about the diametrical line. Each of the first and second hoop spring members 228, 229 overlap at respective base portions thereof so as to define a lower intersection point. The first and second hoop spring members 228, 229 are then secured to the frame member 220 by a single fastener, such as a bolt, screw, rivet or the like, passing through their respective overlapped base portions. In some forms of the invention the lateral portions of the hoop spring members 228, 229 are secured together at an upper intersection point by a further fastener although they could be welded together if desired. Alternatively, in other forms the lateral portions of the hoop spring members 228, 229 are not secured to each other at an end portion thereof but are retained in overlapping pockets providing on the bottom side of the jumping mat 221-225, which hold them in a desired position relative to the overlying jumping mat 221-225 and together but with a small amount of freedom to move with some limited independence.

As can be seen in FIG. 9, inclined mats 231-239 are connected to the inclined frames 250 by further coil spring members 241 in the same manner as the jumping mats 221-225 while adjacent jumping mats 221-225 are connected to each other at respective edge portions thereof by an arrangement of hook and loop fasteners as described in PCT/AU2015/000398 which is incorporated herein in its entirety by way of reference. In another embodiment, the adjacent jumping mats 221-225 are connected to each other at respective edge portions thereof by a similar arrangement to that described above for the mat connection system 1. By way of example, the hoop spring assembly 30 demonstrated in FIGS. 2-5 may be replaced by the hoop spring assembly 230 presently described.

Figure 11:
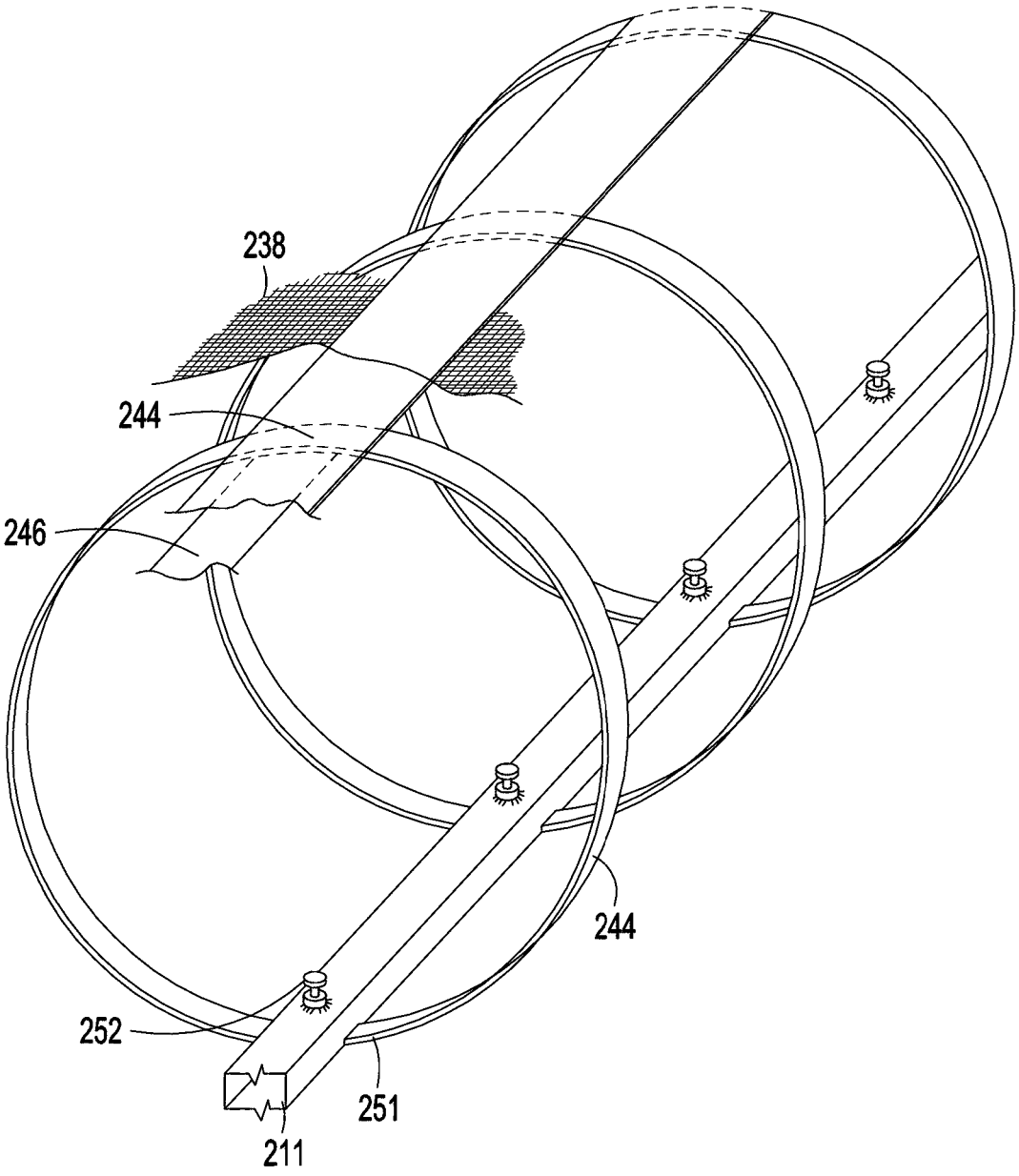
FIG. 11 is a schematic close up view of one centre frame cross member of the trampoline depicted in FIG. 9 showing the spaced apart loop springs connected thereto.

The inclined mats 231-239 are supported at the joint portions thereof by a series or row of cylindrical further hoop spring members 244 which comprise a leaf spring, as can be seen in FIG. 11 in the manner more clearly shown in FIG. 3, which is also described in PCT/AU2015/000398.

Figure 10:
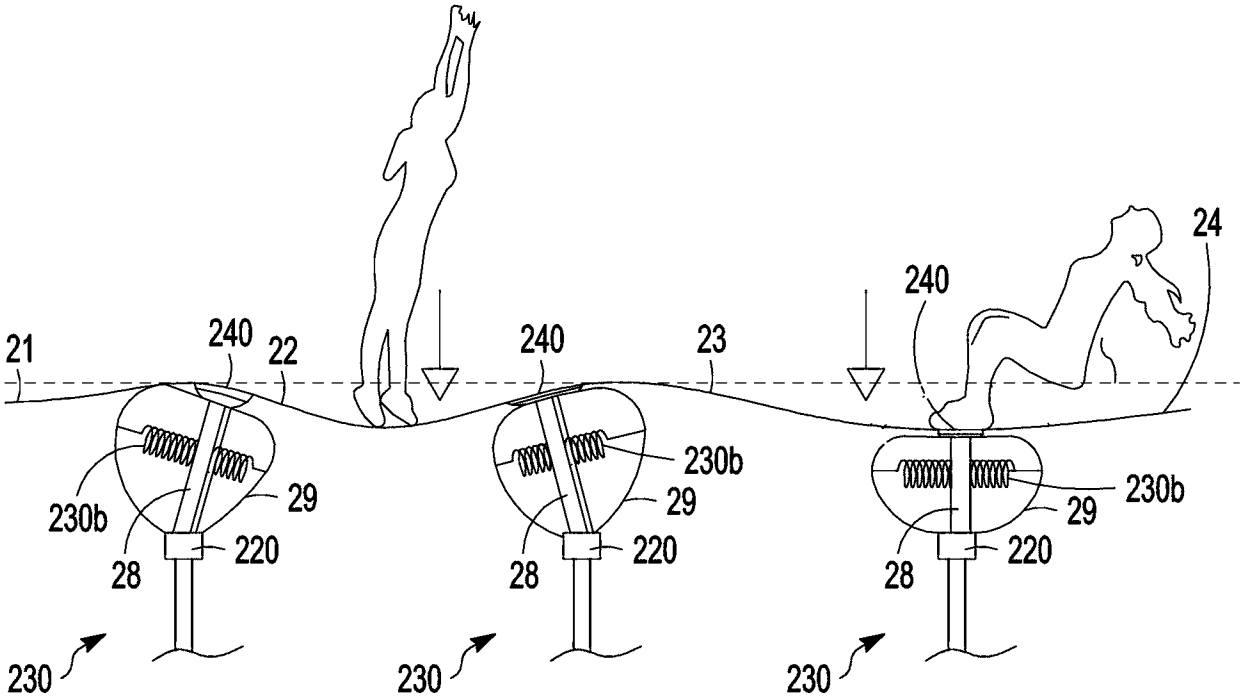
FIG. 10 is a schematic sectional elevation of a multi-mat (or continuous mat) trampoline (or bank of trampolines) similar to the one illustrated in FIG. 9 with rows of the hoop spring assemblies of FIG. 9 at the mat connection regions with four mats and three intermediate (or "centre") frame cross members with centre springs attached thereto, the end frames and end springs are not shown)

It will be appreciated that the mat connection system 210 can be used with the jumping mats 221-225 under the joint portions as illustrated as well as or alternatively at any position between the joint portions, such as illustrated in FIG. 10.

The further hoop spring members 244 disposed under the inclined mats 231-239 are all connected to the frame 211 in the same manner by locating or engaging their bottom end portions in the hollow of the RHS tube via spaced apart slots 251 respectively which are formed in the side walls of the tube and parallel to the longitudinal axis of the tube frame and secured therein by virtue of a bolt 252 as can be seen in FIG. 11. The jumping mats 231 to 239 are connected to the further hoop spring members 244 by straps 246 formed of a plastics webbing material which extend across the underside of the inclined mats 231-239 to form sleeves about the further hoop spring members 244.

Advantageously, a player can jump on the mat immediately above the mat connection system 210 to obtain greater lift than between them. Advantageously, various games can be played whereby players can achieve better performance by being able to pick out the high lift jumping spots on the mat as they move around.

The foregoing description has been given by way of illustrative example of the invention and many modifications and variations which will be apparent to persons skilled in the art may be made without departing from the spirit and scope of the invention as hereinbefore described.

The claims defining the invention are as follows:

1. A hoop spring assembly for use in a mat connection system of a trampoline, the hoop spring assembly comprising:

a first hoop portion and a second hoop portion hingedly and operably connected by a pair of laterally positioned hinge members which each define a pivot point there between; and a resilient member operably connected to each of the pair of laterally positioned hinge members and extending there between.

2. The hoop spring assembly of claim 1, wherein the resilient member is operably connected to each of the pair of laterally positioned hinge members by a pair of respective loop members, wherein each of the pair of loop members is pivotably connected to their respective hinge member and extends inwardly therefrom.

3. The hoop spring assembly of claim 2, wherein each of the pair of loop members comprises a pair of arms pivotably connected to their respective pivot point and a retaining bar extending perpendicularly therebetween, wherein each arm of the pair of arms comprises a series of two or more opposed apertures spaced therealong for receiving an end of the retaining bar therethrough.

4. The hoop spring assembly of claim 3, wherein the position of the retaining bar relative to each arm of the pair of arms is adjustable.

5. The hoop spring assembly of claim 1, wherein said hoop spring assembly is disposed angularly within a second hoop, wherein said hoop spring assembly is engaged to said second hoop at a base portion of said second hoop.

6. The hoop spring assembly of claim 5, wherein the second hoop comprises a second resilient member disposed within the second hoop and extending between lateral portions of the second hoop so as to be operably connected thereto.

7. The hoop spring assembly of claim 5, wherein the hoop assembly is disposed perpendicularly within the second hoop.

8. The hoop spring assembly of claim 1, wherein each of the first and second hoop portions comprise a leaf spring.

9. The hoop spring assembly of claim 1, wherein the resilient member comprises a coil spring.

10. The hoop spring assembly of claim 1, wherein the resilient member comprises an elastic band.

11. The hoop spring assembly of claim 1, wherein a resting tension of the resilient member is adjustable.

12. A mat connection system for connecting adjacent jumping mats of a trampoline, the mat connection system comprising the hoop spring assembly of claim 1 connected to a frame of the trampoline and underlying a joint portion between first and second jumping mats of the adjacent jumping mats.

13. The mat connection system of claim 12, further comprising a spring member disposed between the first and second jumping mats and operatively connected thereto for biasing the first and second jumping mats towards each other.

14. The mat connection system claim 13, further comprising upper and lower protective layers between which is disposed the spring member.

15. The mat connection system of claim 14, further comprising an intermediate layer disposed between the cover layer and the upper protective layer that engages the first and second jumping mats and extends therebetween.

16. The mat connection system of claim 15, wherein the first and second jumping mats each further comprise a skirt extending from a respective end portion thereof so as to be disposed between the intermediate layer and the upper protective layer.

17. The mat connection system of claim 14, further comprising a resiliently compressible portion disposed between the lower protective layer and the hoop spring assembly.

18. The mat connection system of claim 12, further comprising a resilient cover layer configured for covering the joint portion between the first and second jumping mats, wherein the cover layer is adapted to facilitate relative lateral displacement of the first and second jumping mats upon extension and retraction of the spring member.

19. The mat connection system claim 12, further comprising a spring support disposed adjacent and underlying a base portion of the hoop spring assembly and extending circumferentially partly therearound.

20. A trampoline comprising:

a frame;

a jumping mat; and a hoop spring assembly connected to the frame and being disposed below the jumping mat so as facilitate biasing the jumping mat upwards; said hoop spring assembly comprising a first hoop portion and a second hoop portion hingedly and operably connected by a pair of laterally positioned hinge members which each define a pivot point there between; and a resilient member operably connected to each of the pair of laterally positioned hinge members and extending there between.

* * * * *